United States Patent [19]

Arriazu

[11] Patent Number: 4,951,378

[45] Date of Patent: Aug. 28, 1990

[54] PROCESS OF AUTOMATIC SEQUENTIAL PRODUCTION OF POTENTIOMETERS

[75] Inventor: Carlos L. Arriazu, Tudela, Spain

[73] Assignee: Compel, S.A., Pamplona, Spain

[21] Appl. No.: 378,631

[22] Filed: Jul. 12, 1989

[30] Foreign Application Priority Data

Jul. 14, 1988 [ES] Spain ..... 8802484
Jul. 14, 1988 [ES] Spain ..... 8802485

[51] Int. Cl.[5] ..... H01C 17/28

[52] U.S. Cl. ..... 29/593; 29/619; 29/622; 29/844; 29/430; 338/312; 338/313

[58] Field of Search ..... 29/619, 622, 621, 613, 29/610.1, 430, 593, 844, 845; 338/174, 312, 313, 314

[56] References Cited

U.S. PATENT DOCUMENTS

| | | | |
|---|---|---|---|
| 2,736,783 | 2/1956 | Daily | 338/312 |
| 3,574,929 | 4/1971 | Michik | 29/610.1 |
| 3,581,265 | 5/1971 | Falco | 338/174 |
| 3,729,817 | 5/1973 | De Rouen et al. | 29/610.1 |
| 3,869,789 | 3/1975 | Yungblut et al. | 29/613 |
| 4,020,445 | 4/1977 | Kelver et al. | 338/312 |
| 4,523,373 | 6/1985 | Walker, Jr. et al. | 29/610.1 |

*Primary Examiner*—P. W. Echols

*Attorney, Agent, or Firm*—R. A. Blackstone, Jr.

[57] ABSTRACT

A process of automatic sequential production of potentiometers, and potentiometers obtained thereby. The potentiometers are generally low profile rotary-type potentiometers. The potentiometers are formed with a low profile cylindrical casing into which is inserted a laminate electrical resistance element of an incomplete annular shape, the ends of which remain connected to terminals. The casing engages a slider, which is in permanent mechanical and electrical contact with the resistance element and a collector terminal. The slider is assembled on a slider-holder rotatably attached through an aperture formed axially through the body and which is operable from the external surface of the casing. The process consists of automatically assembling the potentiometers in an in-line process. The metallic components are formed on a continuous metallic band by die-cutting the band to produce such components. The die-cut components are moved through the process and at the appropriate stages are removed from the band for assembly with other components of the potentiometer. The resulting potentiometer is attached to one of the original bands whereupon the potentiometers attached thereto are mechanically and electrically tested. After the potentiometers have been completely assembled and tested, they are removed from the final band.

10 Claims, 7 Drawing Sheets

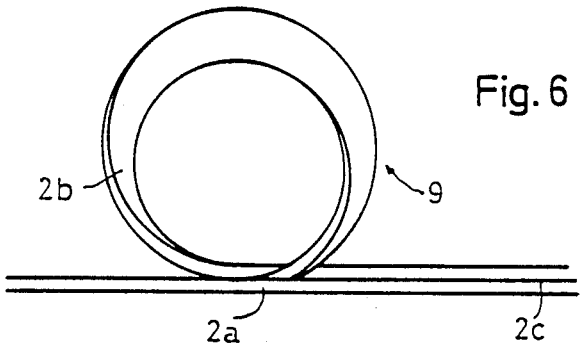
Fig. 6
Fig. 7
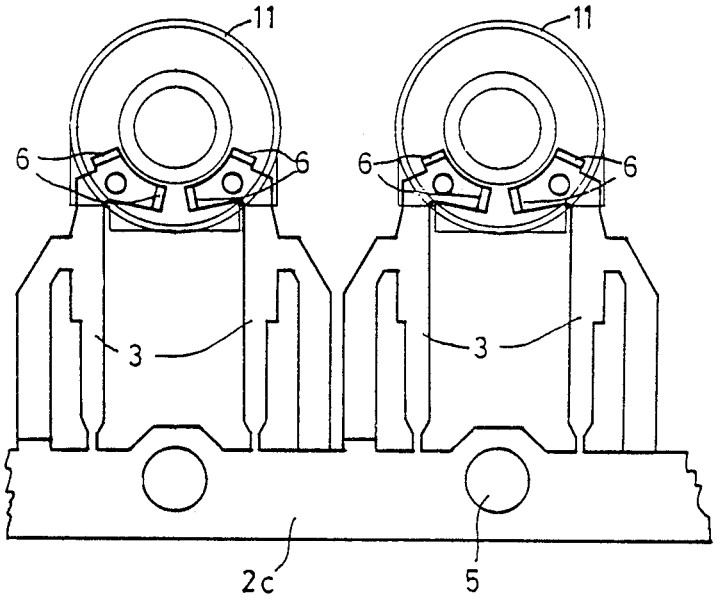

Fig. 8
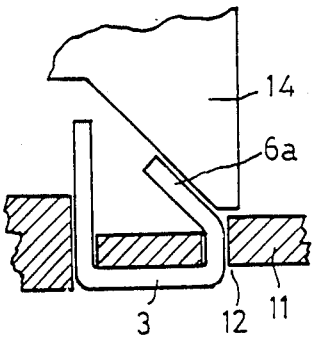
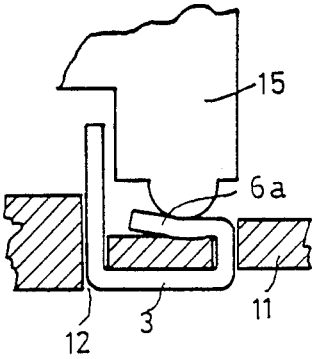
Fig. 9
Fig. 10
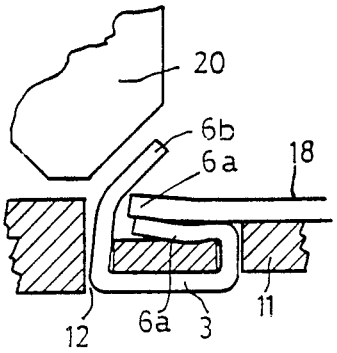
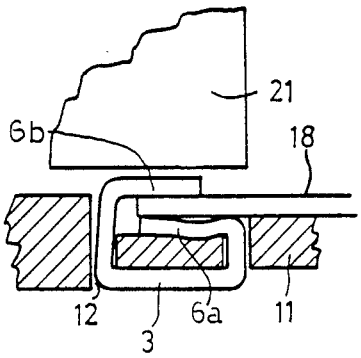
Fig. 11

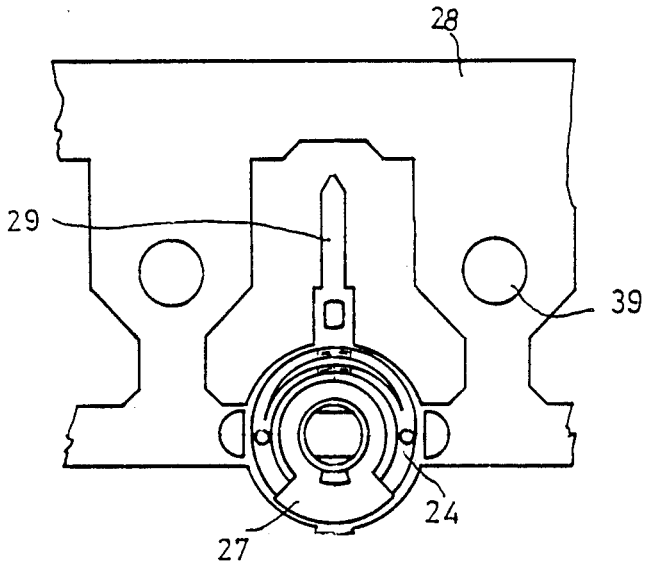
Fig. 15
Fig. 16
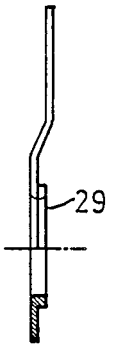
Fig. 17
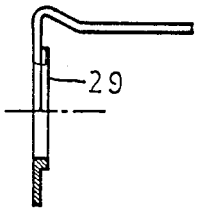
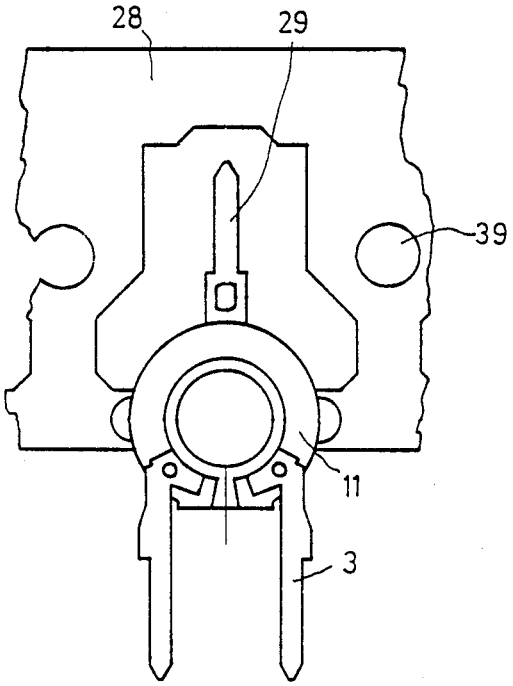
Fig. 18

PROCESS OF AUTOMATIC SEQUENTIAL PRODUCTION OF POTENTIOMETERS

BACKGROUND OF THE INVENTION

This invention relates to a process of automatic sequential production of potentiometers, and potentiometers obtained thereby. More particularly, the potentiometers are of a type which are low profile rotary potentiometers which are automatically assembled and mechanically and electrically tested.

DESCRIPTION OF THE PRIOR ART

As antecedents of the invention, we can note the Spanish invention of patent no. 537,848, and the German patent no. 1,176,241. Each shows a potentiometer production process which uses a laminar metallic band which has been die-cut to form the integral elements of the potentiometer including the collector and the terminals. The process incorporates the rest of the component elements, however, the characteristics of this process are completely different from those of the invention.

Concerning the attachment of the resistant track to the terminals, the following processes and patents are cited:

rivet-attached: U.S. Pat. No. 2,160,142
clamping and riveting: U.S. Pat. No. 2,736,783
stapling: U.S. Pat. No. 4,482,883
cements or cement pastes: Spanish Patent No. 466,765
welding: U.S. Pat. No. 3,354,418
molding: British Patent No. 689,001

BRIEF SUMMARY OF THE INVENTION

The process concerned in this invention is characterized so as to carry out the first of the stages (a) starting from a continuous laminar band, in good electrical conducting material, in which by a die-cut operation, two rows of parallel terminals are configured, perpendicular to the development of such band direction joined by cross strips, in such a way that they remain directly facing each other and lengthwise shifted, starting from alternate sides of the band. Such band presents holes on its side bands, also lengthwise by-passed, to enable an easy pulling of same by transfer equipment. The procedure, in a first stage, is characterized in that it divides lengthwise said band into two pieces, mutually backing later on the two halves in an appropriate orientation, with correspondence of the holes of the side bands and by-passing of the terminals, efficiently utilizing the material used to minimize waste scraps.

Another object of this invention is to attach the terminals to the insulating casing by inserting appendages attached to the terminals through openings formed in the bottom of the casing and folding over a portion of the appendages projecting into the casing to retain the terminals thereon.

The aim of this process is also to transfer the slider and slider-holder on the collecting terminals band, as well as the methodology used to couple one of the bands, that bears the subassembly of stage (a) and a second stage (b) to the other.

BRIEF DESCRIPTION OF THE DRAWINGS

The invention will now be described in detail with reference to the accompanying drawings wherein:

FIG. 6 is a side view showing the dividing two parts of the band into, and superimposing the two bands with correspondence of the holes of its sides and lengthwise by-passing of its terminals by means of a loop;

FIG. 7 is a plan view of the superimposed halves of the bands showing the detail of the arrangement on the double terminal band after the operation of FIG. 6;

FIG. 8 provides a cross-sectional view of the folding of a first appendage of the terminal;

FIG. 9 is a cross-sectional view of the compressive securing of the first appendage having been folded against the casing material;

FIG. 10 is a cross-sectional view whereupon a second appendage of the terminal is folded over the first appendage folded against the casing;

FIG. 11 is a cross-sectional view which shows a resistive element retainably positioned between the folded first appendage and second appendage;

FIG. 15 is a plan view illustrating a slider attached to a collector terminal;

FIG. 16 is a side view of the collector terminal in which the elongate portion of the terminal is generally straight;

FIG. 17 is a side view of the collector terminal in which the elongate portion of the terminal is formed generally at a right angle;

FIG. 18 is a plan view showing the complete assembly of the potentiometer which remains attached to the terminals band.

DETAILED DESCRIPTION OF THE ILLUSTRATED EMBODIMENT

Figure 1:
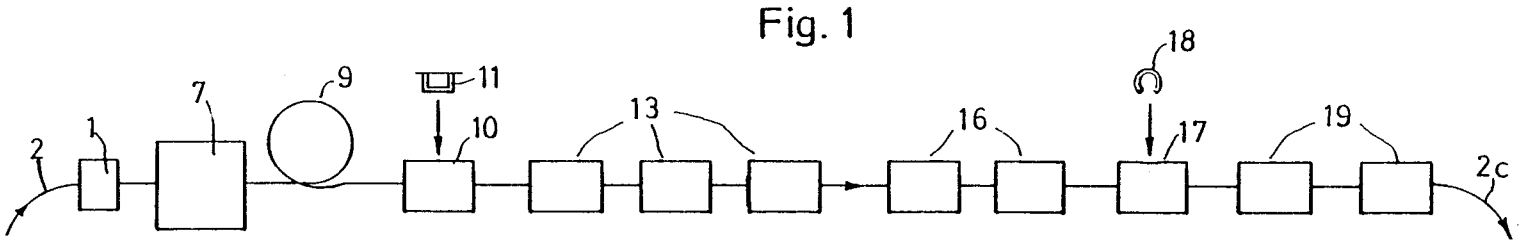
FIG. 1 is a block diagram, representative of stage (a) of the process.
Figure 2:
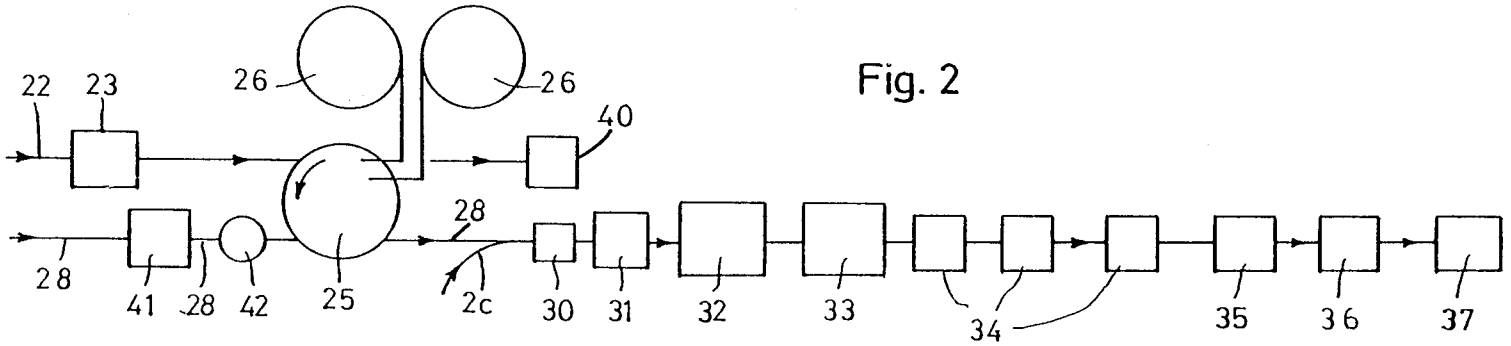
FIG. 2 is a block diagram of the remainder of the process shown in FIG. 1 including a portion at the left side thereof corresponding to stage (b) of the process.
Figure 3:
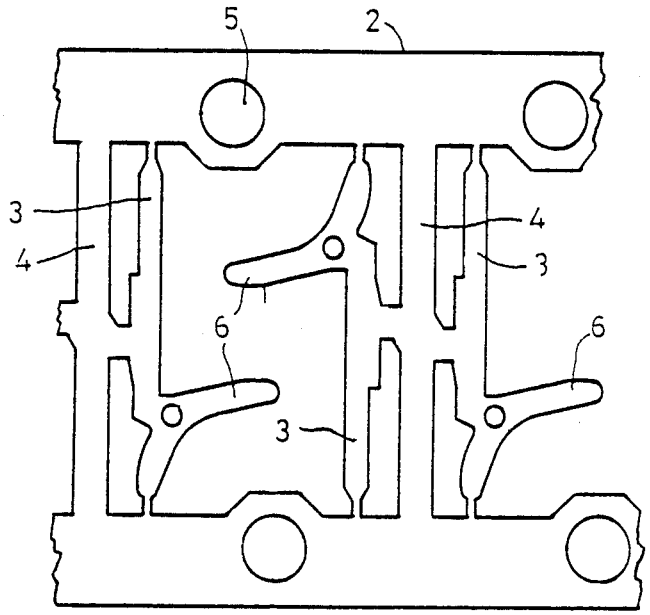
FIG. 3 is a plan view of a portion of the band of terminals after the first die-cut operation that configures the elements according to two rows of parallel, alternate, by passed elements.
Figure 4:
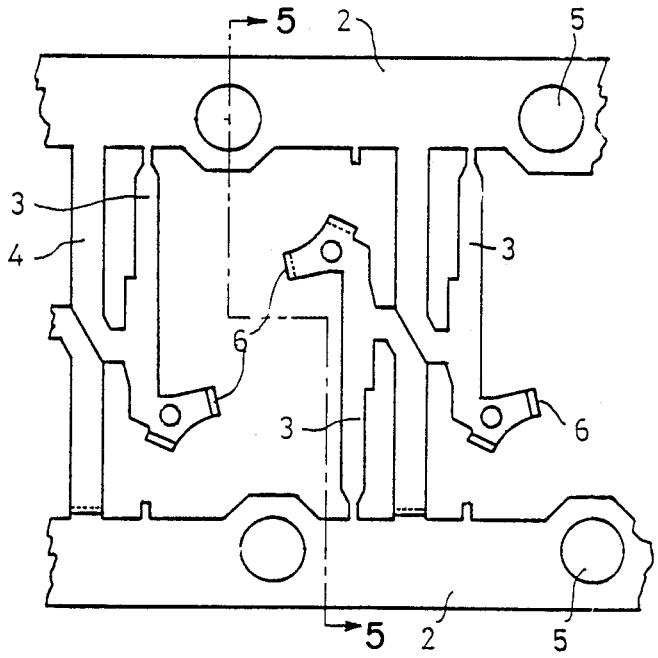
FIG. 4 is a detailed plan view of the elbowing of the appendages at the ends of the terminals.

In accordance with what has been expounded above, and with particular reference to FIGS. 1 and 2, the process proposed comprises a station 1, in which a laminar belt or band 2, which is made of a material which conducts electricity well, has previously been die-cut, and has such a structure as depicted in FIG. 3, is lubricated, and comprises rows of terminals 3, which are parallel and joined by transverse strips 4, the terminals 3 originate from alternate sides of the belt 2, in which apertures 5 are longitudinally displaced; the terminals 3 end in curvilinear appendages 6.

Figure 5:
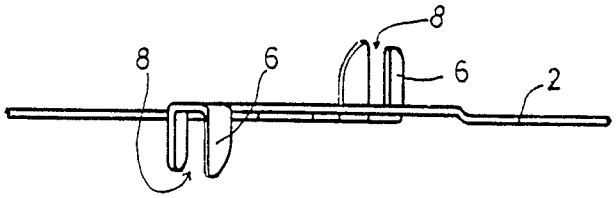
FIG. 5 is a cross-sectional view of the band taken along line 5—5 in FIG. 4.

The said belt 2, which bears the terminals 3, is, during the first operation, subjected, by means of the station 7, to the forming of appendages 6, in order to shape them into the pattern of a fork 8, as is depicted in FIG. 5.

Subsequently, the belt 2 is divided into two parts in a central longitudinal plane, proceeding longitudinally from one of the half-parts 2*a*, with the second half-part 2*b* being turned over by means of a loop 9 (see FIG. 6), and subsequently being superimposed to the other half band 2*a*, with an exact correspondence of its lateral band and a longitudinal distribution of terminals between the apertures 5, thus obtaining a double band of terminals.

Then, the following step in station 10 proceeds to the placing of a vessel-shaped casing 11, which is associated with the band 2*c* of terminals, where the appendages 6, which are fork shaped 8, are, through radial apertures 12, inserted into the bottom of the said casing 11 (see FIGS. 8 through 11), as FIG. 7 depicts in detail.

Subsequently, the bending of one of the first appendages or the legs 6 against the bottom of the casing is carried out by means of the station 13; this is carried out by means of a two-stage bending, as is depicted in complete detail in FIGS. 8 and 9. It can be seen in FIG. 8 that a clamping tool 14 brings about an angular bending of one of the appendages 6. Subsequently, a second pressing tool 15 applies pressure to the intermediate zone of the appendage 6, which was previously angularly bent, bending it against the bottom of casing 11 at an angle of 90°. A portion 6*a* of appendage 6 remains slightly lifted.

Following the assembly line referred to in FIG. 1, we now find stations 16, in which the engraving of graphic characters, such as serial codes, type, etc., is carried out by means of traditional techniques on the external surface of the potentiometer body.

Figure 19:
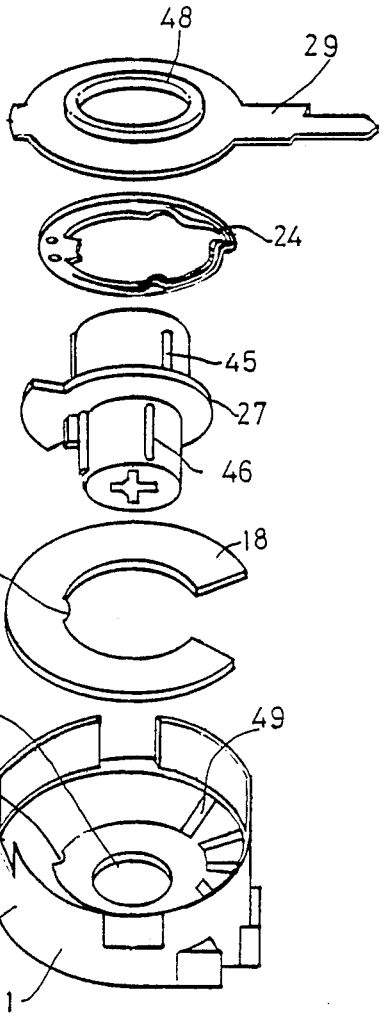
FIG. 19 is an exposed perspective view of the potentiometer obtained from the process.

Subsequently, at the station 17, the resistor is introduced into the casing 11, for which purpose an arcuate resistive element 18 is provided with a protuberance 43 (as best shown in FIG. 19) which facilitates its positioning, acting in relation to a feeding channel guide, as well as in relation to a casing 11, in which there is a recess 43*a* in the cylindrical wall which delineates the seat of the said resistive element 18.

Subsequently, at stations 19, the final clamping of the extremities of the resistive elements is carried out by bending one of the appendages 6, which end in the terminals 3, this operation being carried out in two stages by means of clamping tools 20 and 21, as depicted in FIGS. 10 and 11, respectively.

Referring to FIG. 11, it will be noted that a free end 6*c* of the resistive element 18 is clamped between the extremities 6*a* and 6*b* of the appendages 6 of the terminals 3, in which the first of the said appendages 6*a*, due to its particular bent configuration, provides an elastic reaction, which increases the stability of the mechanical bond.

Figure 12:
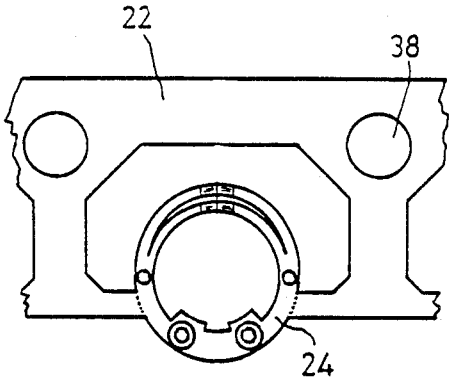
FIG. 12 is a plan view of a band in which sliders have been formed.
Figure 13:
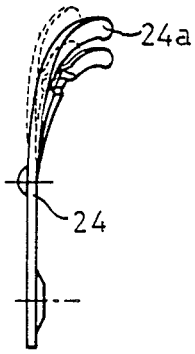
FIG. 13 is a side view illustrating the detail of the curving of the part of the slider which is supported on the resistance element.
Figure 14:
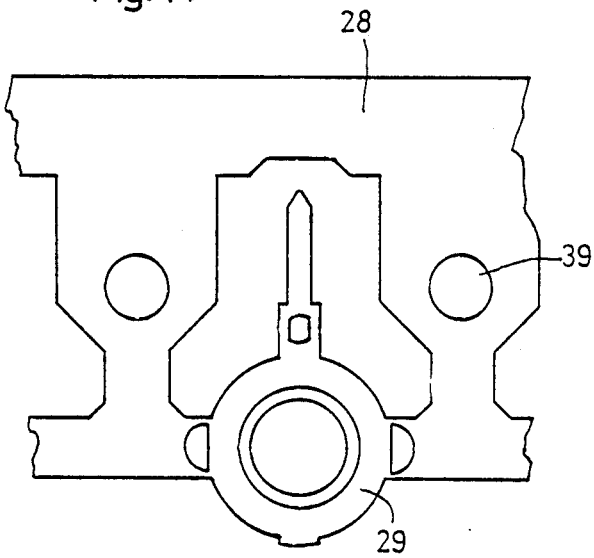
FIG. 14 is a plan view portion of a band in which collector terminals are formed.

For the formation of the sub-assembly of stage (b), the operation begins with a belt 22 which is subjected to a first die-cut at the station 23, at which station a complete configuration of the sliding units 24 is obtained, as shown with detail in FIG. 12, the elements 24 of which show a bending of their portion 24*a* at the moment of entering the station 23, said portion having the purpose of making contact with the resistive element 18.

Subsequently, the sliding belt 22 tangentially enters rotary transfer station 25, to which station the slide-holding units 27 are also conducted by means of feeding units 26; the slide-holders are inserted into the sliding units 24, and, from this moment on, the sub-assemblies bearing the slide-holding units 27 and the sliding unit 24, become separated, unit-by-unit, and are transferred by means of a rotary unit 25 to a belt 28 of collectors 29, which belt is die-cut at the station 41 and lubricated within the unit 42, thus forming a composed assembly in the form of a band, as depicted in FIG. 15.

Subsequently, the said belt 28, after integrating the subassembly of stage (b), proceeds linearly to the assembly station 30 where it is attached to the band 2*c*, and the subassembly of stage (a) is integrated on the same band.

At the station 31, the bonding of the peripheral areas of the casing entrance is carried out on the peripheral area of the collector by means of thermal riveting; within the station 32, the tips of the terminals attached to the band 2*c* are separated therefrom, the double band 2*c* is eliminated, and the potentiometers are supported by means of the collector belt 28.

After that, at the station 33, which is controlled by means of a microprocessor, the units, while still organized in the form of a belt, are checked, unit by unit, with regard to the electrical characteristics of the potentiometers.

The die-cutting and forming of the potentiometer terminals are, depending on the assembly characteristics which are required (vertical or horizontal), subsequently carried out in the stations 34; FIG. 16 and 17 represent two possible arrangements for the collector 29.

Subsequently, the potentiometers which have successfully passed the check-up stage are separated in the stations 35, and the defective potentiometers are collected in the following unit 36; in both cases, they are separated from the belt 28, which continues moving until it is finally sectioned at station 37, in order to simplify the storage of waste material.

Although this has not been explicitly stated in detail, all the bands under consideration are equipped with guide apertures, which are indicated by number 5 for the belt 2; number 38 for the belt 22; and 39 for the belt 28.

After the rotary station 25, the belt 22 is recovered in the station 40 where, in the same manner as for belt 28, it is suitably cut into sections.

As illustrated in FIG. 19, the potentiometer assembled by the process of the present invention comprises a casing 11 formed of an insulating material and formed for receiving and retaining operational components thereof. The arcuate resistance element 18 is formed with a protuberance 43 which is operatively coupled with a corresponding recess formed in the casing 11. The ends of the resistance element 18 have the appendages 6 of the contact terminals 3 deformably attached thereto as better illustrated in FIGS. 10 and 11. The appendages are cooperatively formed to engage the grooved passageways 49 formed in the casing 11. The casing 11 also retains the slider holder 27, on which are formed protuberances 45, 46 on the outside walls thereof to provide friction when engaged with the inwardly facing surface of an aperture 50 formed through the bottom of the casing 11 and correspondingly an aperture formed through the collector plate 29. The collector plate 29 is also formed with an annular projection 48 which engages the protuberances 45 to axially fix the collector to the holder 27.

While a particular embodiment of the present invention has been shown and described in detail herein, it may be apparent to those skilled in the art that changes and modifications of the present invention, in its various aspects, may be made without departing from the invention in its broader aspects, some of which changes and modifications being matters of routine engineering or design, and others being apparent after study. As such, the scope of the invention should not be limited by the particular embodiment and specific construction described herein, but should be defined in the appended claims and equivalents thereof. Accordingly, the aim of the appended claims is to cover all such changes and modifications as fall within the true spirit and scope of the invention.

I claim:

1. A process for the sequential and automatic production of potentiometers, said potentiometers comprising a non-conductive vessel-shaped casing, an arcuate resistance element disposed in said casing and being connected to said casing with connection terminals, a sliding unit-holder to which is attached a sliding unit by means of a generally circular collector plate parallel to and superimposed on the resistance element, said collector plate extending to form a collector terminal, said process for the sequential and automatic production of said potentiometers comprising the following steps: providing a continuous laminar band; moving said laminar band through process apparatus along a predetermined path of travel; forming at least two parallel rows of terminals in said laminar band for assembly along said path of travel; said terminals being positioned opposite one another and longitudinally displaced along said band to permit automated assembly thereof; positioning said casings proximate said band for operative engagement of said terminals within said casing; forming a first sub-assembly which integrates the casing, a resistance element and terminals in the form of a first continuous band, the terminals being initially formed from said continuous band; forming a second sub-assembly comprising said sliding unit-holder, said sliding unit and said collector plate also on a second continuous band; coupling both sub-assemblies in the form of a third continuous band; and electrically and mechanically testing each potentiometer attached to said band.

2. A process according to claim 1 further including: guidedly introducing the band on which the connection terminals are configured along a predetermined path of travel; advancing said band to a first die-cut and preforming station; dividing said band at said first station longitudinally along a central axis for creating a first and second band of terminals; inverting one band in its plane by means of a loop; superimposing said first band over said second band, the second band retaining its original position; positioning said first and second bands relative to each other to achieve registration between lateral apertures formed respectively therethrough, said first and second bands forming equidistance pairs of terminals which are substantially close and continuous terminals originating from opposedly superimposed bands.

3. A process according to claim 1 wherein the formation of said first sub-assembly includes: providing first and second appendages having a U-shaped fork configuration extending therefrom attached to a first side of said continuous band; providing a second formation of appendages laterally displaced and attached to said first formation of appendages attached to a second side of said band; inserting the appendages through openings formed in a bottom surface of said casing appropriately positioned over said band; bending one of said appendages which are internally located with respect to the casing over a portion of said resistance element positioned within said casing for retaining said resistance element therein.

4. A process according to claim 3 further including forming the first appendage of the terminals against the bottom of the body casing in a two-stage bending process, said process determining the configuration of a free portion of said appendages such that said second appendage is folded over said free end of said resistance element.

5. A process according to claim 1, further including providing the resistance element with a protuberance for guiding said resistance element by matching a groove formed in said casing to provide positive positioning of said resistance element in a bottom portion inside said casing.

6. A process according to claim 1, further including: providing a second band having formed thereon and attached thereto sliding units; providing a third band having formed thereon collectors; forming said sliding units with portions for engaging said collectors; positioning said third band in registration with said second band and attaching said collector to said sliding unit; removing said sliding unit from said second band; positioning said third band relative to said first band for engaging said sliding unit and collector with said first sub-assembly.

7. A process according to claim 1 further including assembling said first and second sub-assemblies; separating said appendages attached to said first band, retaining said assembled first and second sub-assemblies on said third band; testing the electrical characteristics of each of the potentiometers attached to said third band; and separating said potentiometers from said third band according to the results of said electrical and mechanical testing.

8. A process according to claim 1, in which individual bands are further formed to their required orientation in the finished potentiometer.

9. A process for the sequential and automatic production of potentiometers, said potentiometers being formed of a non-conductive vessel-shaped casing, an arcuate resistance element disposed in said casing, connection terminals protruding through openings formed in a bottom portion of said casing and connecting to said resistance element, a sliding unit holder, a sliding unit and a collector plate positioned parallel to and superimposed on top of the resistance element, a collector unit having an aperture formed therethrough for receiving said sliding unit-holder with said sliding unit and collector plate attached therewith, a downwardly projecting portion of said sliding unit-holder projecting through an aperture formed in a bottom portion of said casing, an upwardly projecting portion of said sliding unit-holder projecting away from said casing, said downwardly projecting portion of said sliding unit-holder projecting through said aperture in said casing being thermally deformed to movably retain said sliding unit-holder in said aperture, said process comprising the following steps: providing a continuous band; forming at least two opposed rows of connection terminals in said band; moving said band along a predetermined path of travel; forming appendages on said connection terminals; separating said at least two rows of said terminals formed in said band to form first and second separate bands, each band having at least one row of terminals; superimposing said first and second bands; positioning said casings relative to said appendages formed on said connection terminals; inserting said appendages into openings formed in a bottom portion of said casing; bending said appendages inserted into said openings formed in a bottom portion of said casing to retain said casing thereon; providing a third and a fourth band; forming sliding units in said third band; forming collector units in said fourth band; forming said collectors for cooperatively engaging said sliding units; imposing said collector unit over said sliding unit and attaching said slide-holding unit thereto; removing said sliding unit from said third band; positioning said fourth band relative said first band for engagement of said sliding units and collectors attached thereto with said casing; engaging said fourth band with said first band; removing a resultant assembly from said first band; testing the electrical characteristics of said assembly; testing the mechanical characteristics of said assembly; and removing said assembly from said fourth band.

10. A process according to claim 9 wherein said assemblies formed thereby and removed from said third band are removed according to the test results from the electrical and the mechanical testing thereof.

* * * * *